United States Patent [19]

Spötzl et al.

[11] 4,438,677

[45] Mar. 27, 1984

[54] MUNITION-SUPPLY SYSTEM FOR AN ARMORED VEHICLE WEAPON

[75] Inventors: Markus Spötzl; Erich Drosen, both of Munich; Leonhard Pongratz, Karlsfeld; Ferenc Kotai, Munich, all of Fed. Rep. of Germany

[73] Assignee: Krauss-Maffei Aktiengesellschaft, Munich, Fed. Rep. of Germany

[21] Appl. No.: 318,989

[22] Filed: Nov. 6, 1981

[30] Foreign Application Priority Data

Nov. 6, 1980 [DE] Fed. Rep. of Germany ..... 3041866

[51] Int. Cl.[3] ..... F41H 7/06; F41H 5/20; F41F 9/06

[52] U.S. Cl. ..... 89/36 K; 89/47

[58] Field of Search ..... 89/45–47, 89/36 K, 33 B, 33 A, 33 SF, 33 BA

[56] References Cited

U.S. PATENT DOCUMENTS

| | | | |
|---|---|---|---|
| 3,724,324 | 4/1973 | Zielinski | 89/45 X |
| 3,986,432 | 10/1976 | Schreckenberg | 89/45 |
| 3,988,962 | 11/1976 | Elwin | 89/46 |
| 4,318,331 | 3/1982 | Echtler et al. | 89/47 X |
| 4,324,169 | 4/1982 | Rüttgerodt | 89/36 K X |

FOREIGN PATENT DOCUMENTS

| | | | |
|---|---|---|---|
| 2027586 | 12/1970 | Fed. Rep. of Germany | 89/46 |
| 2141937 | 3/1973 | Fed. Rep. of Germany | 89/36 K |
| 2349185 | 3/1975 | Fed. Rep. of Germany . | |
| 2501425 | 7/1975 | Fed. Rep. of Germany | 89/45 |
| 2501426 | 7/1975 | Fed. Rep. of Germany | 89/47 |
| 2818279 | 11/1979 | Fed. Rep. of Germany . | |
| 3016928 | 11/1981 | Fed. Rep. of Germany . | |
| 2444247 | 8/1980 | France | 89/46 |

*Primary Examiner*—Donald G. Kelly

*Attorney, Agent, or Firm*—Karl F. Ross; Herbert Dubno

[57] ABSTRACT

An armored vehicle with a rotatable turret, e.g. a tank, has its gun (cannon) supplied from a munitions bunker behind the turret in which the munitions rounds are stored in tubes inclined at angles less than 90° to the axis of the gun when the breech thereof is aligned with an opening in the magazine through which the rounds are fed from a tunnel in the magazine aligned with the gun. The rounds lie in substantially horizontal planes and are withdrawn from storage tubes by a device movable axially along the tunnel and swingable into alignment with each tube to withdraw the round therefrom and feed it through the opening into the breech of the gun.

11 Claims, 6 Drawing Figures

MUNITION-SUPPLY SYSTEM FOR AN ARMORED VEHICLE WEAPON

FIELD OF THE INVENTION

Our present invention relates to the supply of munitions to artillery pieces and particularly to the feeding of successive munitions rounds to the gun of an armored vehicle. More specifically, the invention pertains to the weapon (cannon) of a rotatable tank turret and the storage of the munitions rounds therefor and the supply of such rounds to this weapon.

BACKGROUND OF THE INVENTION

Heavy weapons which are provided with, for example, a gun such as a cannon, e.g. the cannon of a tank turret, must be supplied with munitions rounds from a munitions magazine or bunker in the vehicle and to this end means can be provided for withdrawing each round from the magazine, delivering it to the region of the breech and fbr inserting the round into the breech before firing.

An automatic loading system for this purpose is described, for example, in German open application No. 29 48 146. In this arrangement the munitions magazine is formed in a pod or compartment at the rear of the turret and the magazine stores the munitions in a circulating system progressively advancing the munitions rounds to a fixed position for each of two munitions bunkers from which the rounds are extracted and inserted into the breech.

This system has the disadvantage that for the insertion of each round into the breech of the gun, it is necessary for the entire circulating magazine to be activated and all of the rounds thereof moved in order to position the single round to be fed into the aforementioned fixed position. When this round reaches the fixed position, the driven mass must be brought to a stop. The displacement and stopping of the circulating magazine is time and energy consuming, requires a large drive facility and poses a danger within the vehicle.

Even more significant, in some cases, is the disadvantage which arises when munition rounds of different types may have to be selected for a particular attack on a given target. If this round is not the next round in the sequence, the magazine must be driven until the appropriate round reaches the location at which it is to be extracted from the magazine. This is especially time-consuming and requires that the entire magazine by driven, possibly over practically the entire path thereof until the desired round reaches the extraction location.

Obviously this system is expensive to fabricate, utilizes space in the munitions pod or compartment which might be better utilized for additional munitions, creates problems with maintenance and repair and may result in long downtimes for maintenance.

Another system utilizing circulating rounds in a magazine is described in U.S. Pat. No. 3,724,324, this system suffering some of the same disadvantages as have been ascribed to the arrangement of the German open application No. 29 48 146.

Mention may also be made, in this connection, of German Auslegeschrift No. 23 49 185 which discloses arrays of munitions bunkers on either side of a magazine but is also highly space consuming and inconvenient to use although it does not have all of the problems associated with systems in which the entire body of munitions rounds of a particular bunker must be displaced in order to allow extraction of a single round.

OBJECTS OF THE INVENTION

It is the principal object of the present invention to provide a space conserving, i.e. compact, munitions storage and gun-feeding system, especially for the turret of a heavy armored weapon such as a tank, whereby the disadvantages of earlier arrangements are avoided.

Another object of the invention is to provide a munitions feed system for the cannon of a rotatable turret which has low fabrication, maintenance and repair cost and which allows more rapid loading of the gun.

SUMMARY OF THE INVENTION

These objects and others which will become apparent hereinafter are attained, in accordance with the invention, in a system for supplying munitions rounds to the breech of a gun of a heavy weapon especially a tank turret cannon, which comprises, in combination, a munitions storage compartment which is swingable to traverse with the gun and is connected to the compartment containing the gun, e.g. a personnel compartment of the turret, by an opening which can be aligned with the breech of the gun and lies in the vertical plane of the gun axis.

Two magazines are provided in the magazine compartment on opposite sides of a tunnel aligned with this opening and in each of these magazines, the individual munitions rounds are stored in respective holding tubes in substantially horizontal planes, the rounds in each plane being offset from one another parallel to the axis of the gun when the breech of the latter is aligned with the aforementioned opening, the tubes and hence the rounds in each magazine being mutually parallel.

The tubes have individual openings through which the rounds can be extracted turned toward the tunnel which is provided with an extraction and loading mechanism shiftable along the tunnel linearly and swingable in a vertical plane to align the extraction tube with the openings of the storage tubes selectively and in a horizontal plane to swing the extracted round into alignment with the compartment opening or window and hence with the breech of the gun.

According to a feature of the invention, this munitions compartment is located as a pod on the rear of a tank turret in alignment with the loading breech of the gun and the axes of the munitions-holding tubes include angles less than 90° with the aforementioned plane whereby the ends of the tubes through which the rounds are retracted are turned rearwardly and inwardly.

Between the personnel compartment and the munitions compartment, an armored wall can be provided which is formed with the aforementioned feed opening and it has been found to be advantageous to provide an armored closure device for this opening or window. The latter device can be automatically actuated when a round is to be fed through the window.

The pod may be detachably connected to the turret and can allow rapid replacement of the munitions magazines and the aforementioned mechanism, together with unspent rounds, the replacement pod carrying a full load of rounds and enabling the replaced pod to be maintained or repaired without impeding further use of the tank.

Each magazine can, moreover, be subdivided into a number of subcompartments or submagazines, separated from one another by armored walls and the outer walls of the pod and hence of the magazines and the tunnel can be armored as well.

Pressure relief, in the event of an explosion within the magazine pod can be provided by walls, e.g. lateral, upper or rear walls, which are easily detached by the explosion forces.

The feed mechanism can comprise a carriage which is axially shiftable on rails along the tunnel and is connected to the feed tube by a pivot rotatable about a vertical axis on the carriage and arms connecting the feed to the latter pivot to allow articulation about a horizontal axis. The carriage can be formed by a frame riding via rollers on the rails and provided with a motor pinion which engages a toothed or cog belt connected to a horizontal or a tunnel, to an upper or lower wall thereof.

Most advantageously, in this connection, the rails and belt are provided along the top of the pod on a cover plate for the latter, this plate being dismountable from the pod to allow replacement of the entire loading mechanism as a unit if required.

The loading tube itself can be of the telescoping type described, for example, in German patent document No. 28 18 279 corresponding to German application No. P 28 18 279.8.

The lateral walls of the munitions compartment can be provided with one or more closable ports through which munitions can be inserted into the holding tubes which, for this purpose, can be open at both ends.

It has been found to be advantageous, moreover, to provide an additional antechamber at the end of the pod remote from the charging window which will allow full rotation of the feed tube or rotation through at least 180°, this antechamber having an opening affording access to the exterior as well. This antechamber and its opening can be located substantially at the level of the highest plane in which the munitions rounds lie and can serve the holding tubes. It has been noted that in the preferred or best mode embodiment of the invention, the magazine compartment which is rotatable in traverse with the gun, is a compartment provided to the rear of the personnel compartment of the turret, i.e. is formed as a pod extending rearwardly of the personnel compartment. This, of course, allows the maximum utilization of the space within the turret and also keeps the magazine ready to feed the gun at any point in the traverse thereof by rotation of the turret.

Especially important is the orientation of the holding tubes so that they include angles of less than 90° with the vertical plane of the gun axis. The munitions rounds can then be extracted rearwardly by an axial movement that involves scarcely more of a displacement sufficient to permit the round to clear the end of the holding tube, whereupon angular displacement about a vertical axis through an angle less than 90° is all that is necessary to bring the round into the plan preparatory to passage through the window at the end of the tunnel.

The inclined orientation of the holding tubes, moreover, allows the width of the turret at the port to be minimized, thereby reducing the front-facing surface which may be exposed as a target to enemy fire. The armored wall between the munitions compartment and the personnel compartment effectively can protect the tank crew against a hit by enemy fire upon the munitions compartment and the explosion of any munition rounds therein. The window can be closed by the closure device mentioned in a plug-type manner, the closure converging in the direction of the crew compartment so that any pressure wave from behind this closure increases the tightness of the fit and protects the crew.

The effect of any hit upon the munitions compartment can be minimized by armored partitions between the subcompartments and by the upper, lower or lateral armoring and/or the explosive-force relief means described.

The detachable pod not only enables maintenance and resupply of one pod while another interchangeable therewith is in use, but also allows selection of the pods with respect to the previously stored rounds as to the type of target to be attacked, and armoring for defense against attack in dependence against the expected nature of the enemy's weapons.

The removability and replaceability of the cover plate carrying the loading mechanism not only permits replacement of a defective loading mechanism without downtime but also allows the interior of the pod to be inspected in a particularly convenient manner.

The provision of lateral ports and a rear port as well as the antechamber which facilitates rotation through 360° or at least 180° of the loading tube allows the insertion of the munitions rounds into the holding tubes from the exterior of the tank directly or within the pod by the loading tube which is supplied with the rounds through the rear port.

Since the loading can be mechanized conveniently in this manner, the loading can be effected with the pod on or off the turret and with the loading being automated.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
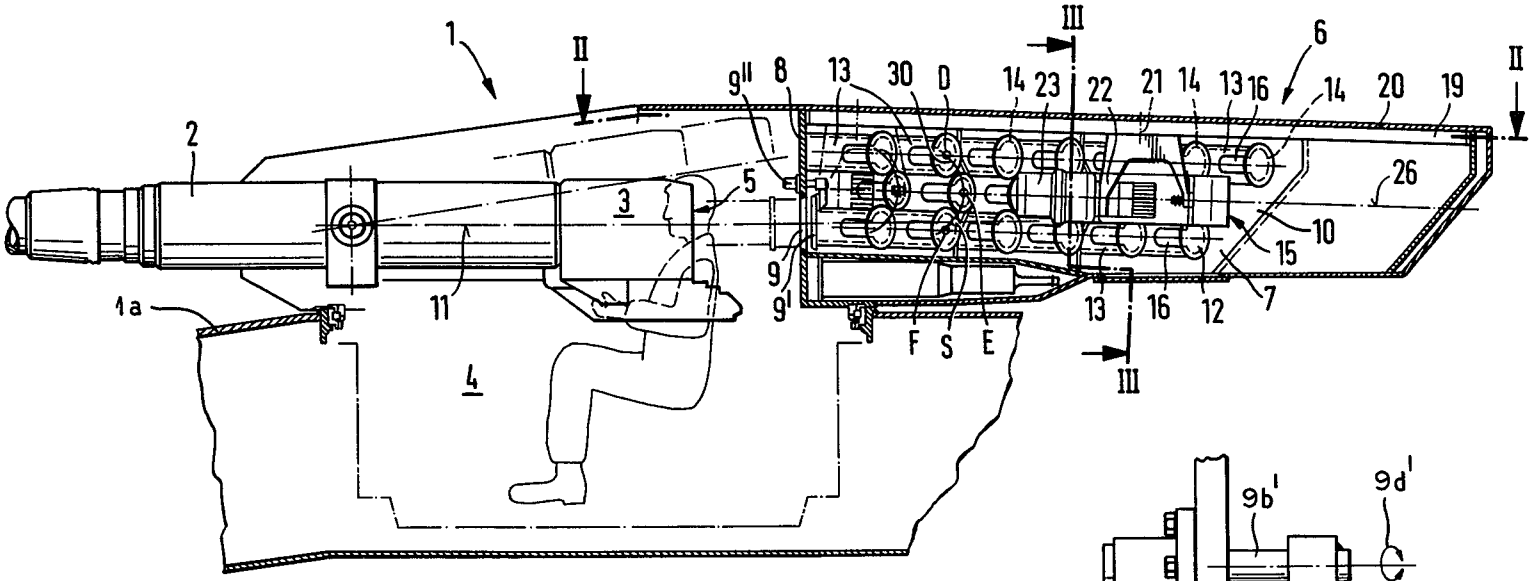
FIG. 1 is a vertical section (taken along line I—I of FIG. 2), partly in diagrammatic form, through a portion of a tank embodying the invention.

The turret 1 of a tank 1*a* shown in FIG. 1 can be provided with a large caliber barrel-type weapon, e.g. a gun or cannon 2 whose breech mechanism 3 is located in a personnel compartment 4 of the turret and, when the breech is opened, has its breech opening 5 alignable with a window 9 in the armored wall 8 separating this compartment from a munitions compartment in a pod 6 disposed rearwardly of the compartment 4 on the turret.

Figure 4:
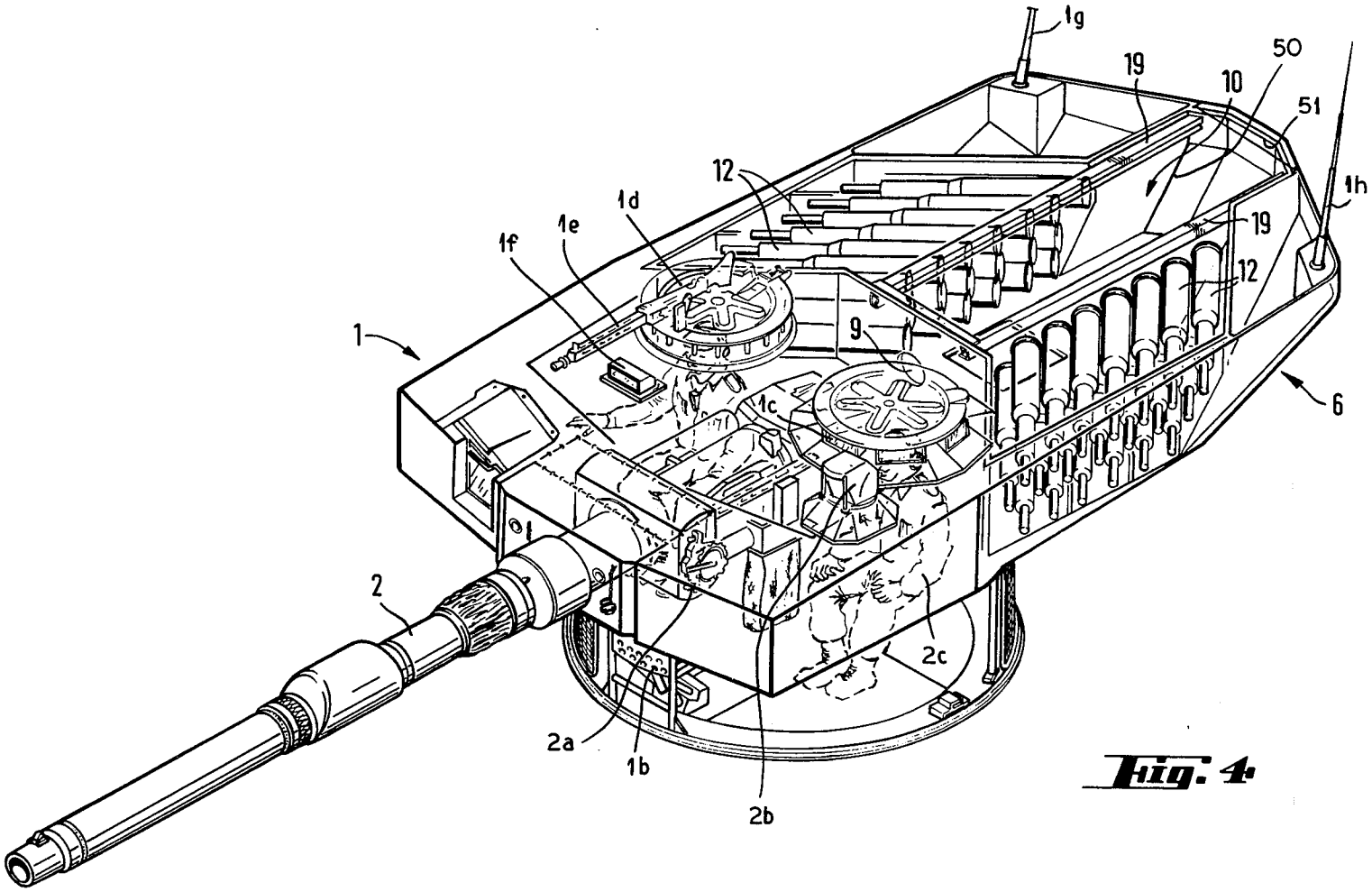
FIG. 4 is a perspective view, with certain walls broken away and likewise in diagrammatic form of the turret of a tank according to the invention.

As can be seen from FIG. 4, the gun can be provided with any of the usual means, represented diagrammatically at 2*a*, for varying the elevation of the gun on the turret, the turret drive being shown at 1b to permit rotation of the turret about a vertical axis and hence travese of the gun.

An aiming mechanism 2b may be provided for the gunner 2c who can view the firing field through window 1c.

The turret also can be provided with a hatch 1d enabling access of the crew to a smaller caliber weapon 1e such as a machine gun, with a periscope 1f, and with any desired means for navigating or weapons control purposes conventional in the art as well as with communications facilities utilizing the antennae 1g and 1h.

The window 9 in the armored wall can be closed from the side of the munitions compartment by a plug-shaped closure 9' so that when this window is open, it communicates between a loading tunnel 10 and the crew compartment of the turret.

The closure 9' can be carried by a arm 9a' affixed to a shaft 9b' actuatable by a servomotor 9'' so that the closure 9' can be axially displaced (arrow 9c') and rotated out of alignment with the opening 9 and the axis 11 of the gun when its breech opening 5 is aligned therewith.

Figure 1A:
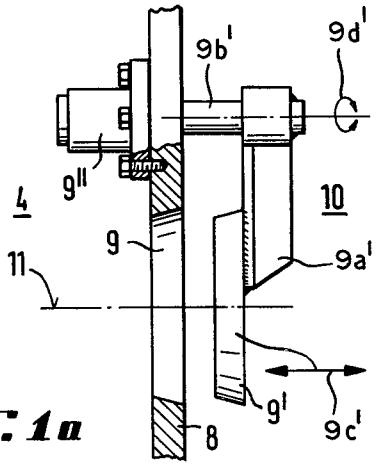
FIG. 1*a* is a detail section drawn to a larger scale of the closure device for the feed window of this invention.

In operation, when loading of the weapon is desired, the closure 9' is first shifted axially to the right out of the opening 9 and into the position shown in FIG. 1a whereupon it is swung as represented by the arrow 9d'' to clear the opening and hence the passage of a munitions round through the opening 9 into the weapon. Immediately thereafter the opening 9 is reclosed so that the danger of injury to the crew is reduced should there be an enemy strike at the munitions pod.

As indicated, loading of a round 12 into the gun 2 requires alignment of the breech opening 5 and the opening 9 along the axis 11, the tunnel 10 extending rearwardly from the armored wall 8 along this axis.

Figure 2:
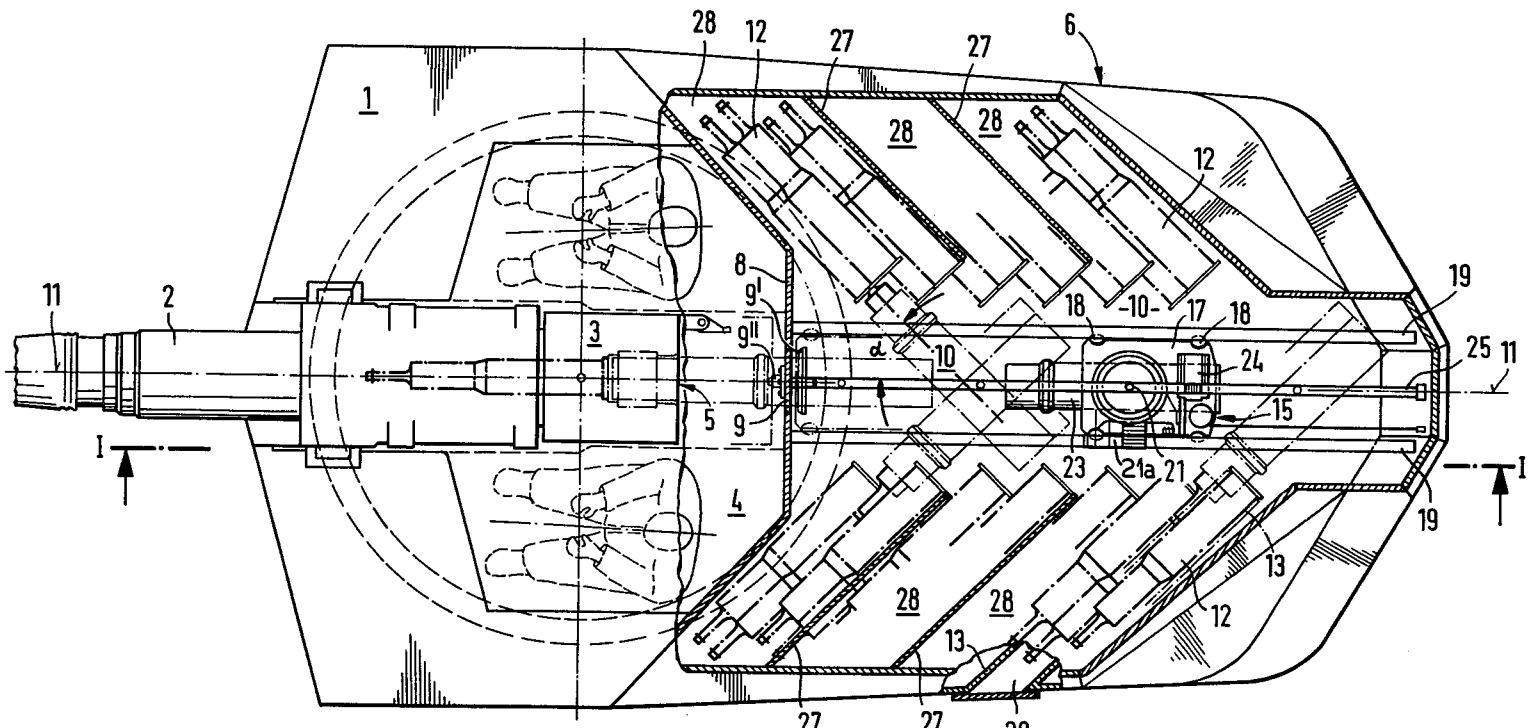
FIG. 2 is a cross-sectional view taken along the line II—II of FIG. 1 and showing the magazine compartment and the mechanism associated therewith from above.

The individual munitions rounds 12 are stored in the munitions bunkers 7 of the pod 6, two such bunkers or magazines being provided on opposite sides of the tunnel 10 and preferably mirror-symmetrically with respect to a vertical median plane of the axis through the pod, i.e. a plane parallel to the axis 11 and perpendicular to the plane of the paper in FIG. 2. This plane includes the axis 21 shown in FIG. 3.

The holding tubes 13 of each magazine 7 are disposed in three mutually parallel substantially horizontal planes disposed one above the other. These planes have been represented at $P_1$, $P_2$ and $P_3$, respectively. Each tube 13 has an axis including an angle $\alpha$ with the axis 11 and hence the vertical median plane through the pod which is less than 90° and so oriented that the rearwardly directed openings 14 of these tubes are turned inwardly.

The result is a fishbone pattern of the munitions rounds as is clear from FIG. 2.

The munitions rounds 12, which can have been inserted in the tubes 13 by a loading device 15 in a manner which will be described in greater detail below, are withdrawn from these selectively and individually by this device.

In the region of the rear openings 14, the tubes 13 have lateral cutouts 16 through which the firing tips of the rounds 12 can be swung thereby reducing the width of the pod which must be provided and limiting the width of the tunnel 10.

The loading mechanism 15 comprises a frame 17 which is shiftable longitudinally on rollers 18 along the tunnel, the rollers 18 riding in rails 19. This direction of displacement is represented by the arrows G and H in FIG. 5. The rails 19 are mounted upon a cover plate 20 which can be composed of armoring, can be easily dislodged from the pod by an internal explosion and can, upon detachment from the pod, allow access to the interior thereof for inspection of maintenance and carries the entire mechanism thereof away from the pod and even replacement by another mechanism-carrying plate so as not to prolong the downtime of the tank.

An arm 22 is pivotally mounted on the frame 17 and can rotate about an upright axis 21 (see FIGS. 3 and 5), a loading tube 23 being articulated to this arm so that it can be swung about the pivot axis 26.

The device for longitudinally displacing the mechanism comprises a servomotor 24 whose pinion 24a engages a cog belt 25 deflected around rollers 24b and 24c, the cog belt 25 being fixed to the plate 20. Other motors such as the servomotor 26a and 21a (FIGS. 5 and 2) effect pivotal displacement of the links 26b carrying the telescoping tube 23 about the pivot 26 and the arm 22 about the axis 21, respectively.

In FIG. 2 the feed tube 23 in the tunnel is shown to be empty while the feed tube in an alternative position as indicated by light dot-dash lines demonstrates the position of the mechanism 15 in the phase in which a munitions round 12 is withdrawn from a holding tube 13 and inserted into the weapon 2.

Intermediate armored partitions 27 subdivide each mechanism 7 into a plurality of subcompartments or zones 28.

On the left-hand side wall of the rearwardly converging pod 6 we have provided a closable reloading opening 29 which communicates with a holding tube 13 open at its opposite ends.

For reloading the magazines, therefore, the individual rounds can be inserted with their shell bases inwardly in succession through the pod 29 and into the tube 13 aligned therewith, each line being extracted by the feed tube 23 and delivered by the mechanism 15 to an empty holding tube 13.

Figure 3:
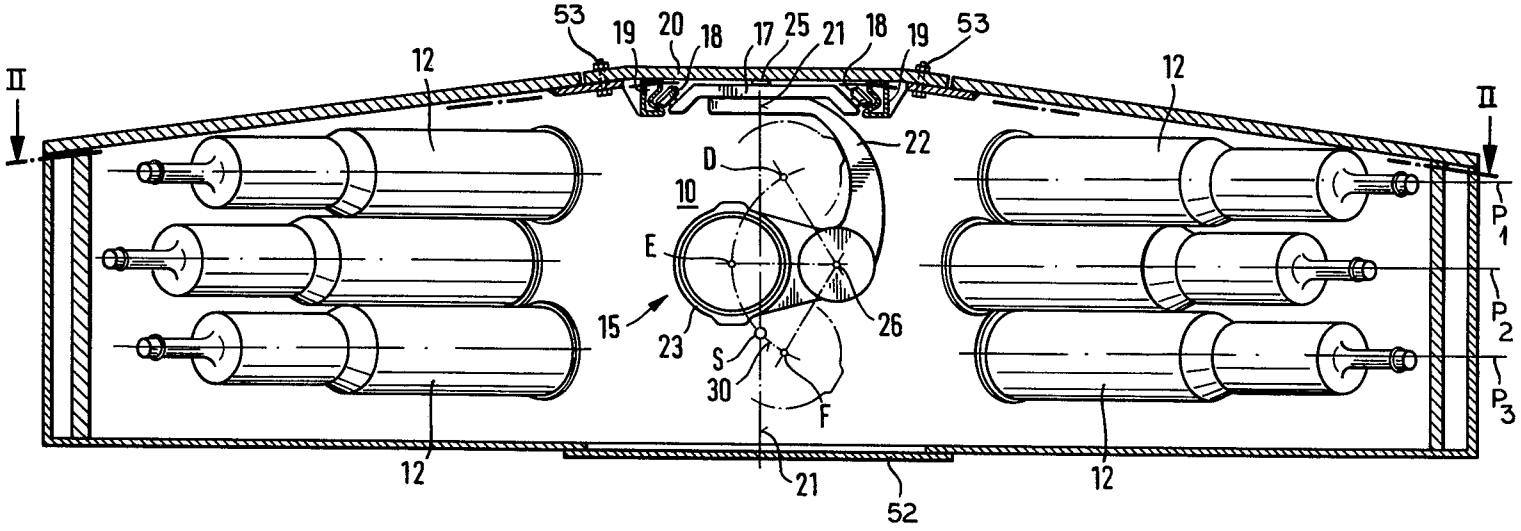
FIG. 3 is a cross-sectional view taken along the line III—III of FIG. 1 looking toward the rear of the pod, the section line II—II being also seen in this Figure.

In FIG. 3, the tunnel 10 is shown in its relationship to the munitions rounds 12 without the holding tubes 13. From this Figure it will be apparent that the axis of the tube 23 can be swung between an upper position D where it is coplanar with the uppermost rounds (i.e. lies in plane $P_1$), to a position in which it lies in the plane $P_2$ and to a position (F) in which it lies in the plane $P_3$, always parallel to the axis 11 when the latter is aligned with the axis of the window 9. The arcuate path of the loading tube 23 is represented at 30 and passes through the axis 11.

Figure 5:
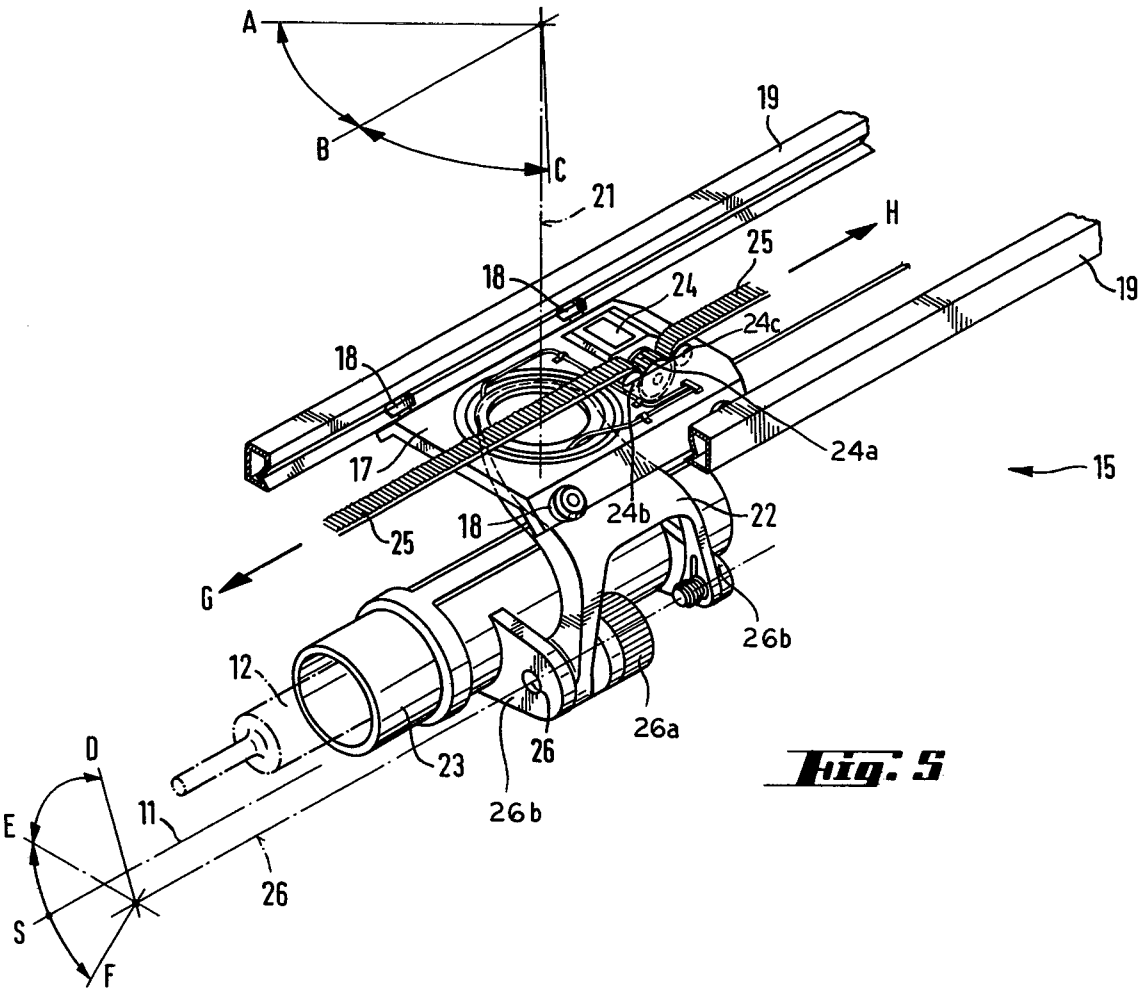
FIG. 5 is a perspective view of the loading mechanism of FIGS. 1 through 4.

From FIGS. 4 and 5 it can be seen that the tube 23 is rotatable about the axis 21 between a position A in which it can be aligned with any of the rounds on one side of the pod and a position C in which it can be aligned with any of the rounds on the opposite side of the pod, upon appropriate axial displacement as represented by the arrows G and H and pivotal displacement about the axis 26. In position B, the tube 23 can be aligned with the axis 11 and the window 9.

Similarly, the positions D, E and F about the axis 26 have been shown.

Once the telescoping tube 23 has extracted a round from one of the tubes 13, the arm 22 is rotated to position the round-carrying tube 23 in the plane of position B and the tube 23 is swung about the axis 26 into the position S in which it is aligned with the opening 9. The closure of this opening is removed and the tube 23 displaced in the direction of arrow G to feed the round through the window 9 and into the breech opening 5 of the gun 2 which has previously been positioned to receive the round.

The empty chamber 50 at the rear of the pod enables at least 180° rotation of the tube 23 about the axis 21 and preferably 360° rotation whereby the tube 23 can be aligned with the port 51 through which loading can be effected.

The pod 6 is a removable unit which can be mounted on the turret releasably and detachably by means not shown and for the resons described.

Some of the walls, as indicated in FIG. 3, e.g. the wall 52 can be released rapidly by the development of internal explosive forces to relieve such forces and, to this end, the bolts 53 securing the plate 20 to the pod may likewise be torn away for pressure relief purposes.

We claim:

1. A weapon supply system for a large caliber weapon comprising:

means forming a munitions compartment rearwardly of said weapon and rotatable therewith upon traversing of said weapon, said compartment having a window opening toward said weapon and through which munitions rounds can be fed to load said weapon;

a plurality of holding tubes disposed in said compartment and adapted to receive respective munitions rounds at spaced-apart locations in a plurality of substantially horizontal planes whereby loading tunnel is formed in said compartment in line with said window, said holding tubes being stationary within said compartment, being provided in arrays on opposite sides of said tunnel, being mutually parallel within each array and having respective round-removal openings turned toward said tunnel; and a loading mechanism in said tunnel common for all said tubes for removing individual rounds from said holding tubes and feeding said rounds through said window into said weapon said loading mechanism comprising:

round-engaging means engageable with a round in a selected one of said holding tubes, means for swingably displacing said round-engaging means about a substantially horizontal axis whereby said round engaging means is positioned selectively in said planes, means for displacing said round-engaging means angularly about a substantially upright axis for selectively and individually aligning said round-engaging means with each of said holding tubes at the respective round-removal openings, and means for shifting said axes and said round-engaging means along said tunnel toward and away from said window.

2. The system defined in claim 1 wherein said compartment is a pod disposed rearwardly of a crew compartment of a tank turret and said weapon is a tank cannon with a breech opening alignable with said window and adapted to receive a round therethrough.

3. The system defined in claim 2 wherein said tubes are oriented so that their axes include angles of less than 90° with an axial plane of the barrel of said cannon with said openings being turned inwardly and rearwardly.

4. The system defined in claim 3 wherein said pod is separated from said crew compartment by an armored wall formed with said window, further comprising armored closure means adapted to block said window.

5. The system defined in claim 3 wherein said pod is detachably connected to said turret.

6. The system defined in claim 3, further comprising armored partitions separating groups of said tubes into subcompartments.

7. The system defined in claim 3 wherein said pod has armored external walls.

8. The system defined in claim 3 wherein said pod as easily detachable wall portions providing explosion relief in the event of an explosion within said pod.

9. The system defined in claim 3 wherein said mechanism comprises a loading tube forming said round-engaging means, a pair of rails extending along said tunnel, and a carriage shiftable on said rails along said tunnel.

10. The system defined in claim 9 wherein said loading tube is carried by an arm swingable about said horizontal axis articulated to another arm rotatable about said upright axis and in turn, connected to said carriage.

11. The system defined in claim 10, further comprising a cog belt extending along said tunnel, said carriage being formed with a motor having a pinion meshing with said belt.

* * * * *